US011180711B2

(12) United States Patent
Sivakova et al.

(10) Patent No.: US 11,180,711 B2
(45) Date of Patent: Nov. 23, 2021

(54) NITROGEN-FUNCTIONALIZED OLEFIN POLYMERS FOR DRIVELINE LUBRICANTS

(71) Applicant: The Lubrizol Corporation, Wickliffe, OH (US)

(72) Inventors: Sona Sivakova, Painesville, OH (US); David M. Nickerson, Concord Township, OH (US); Paul Simon O'Hora, Belper (GB); William R. S. Barton, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/638,632

(22) PCT Filed: Aug. 16, 2018

(86) PCT No.: PCT/US2018/000173
§ 371 (c)(1),
(2) Date: Feb. 12, 2020

(87) PCT Pub. No.: WO2019/035905
PCT Pub. Date: Feb. 21, 2019

(65) Prior Publication Data

US 2021/0130732 A1 May 6, 2021

Related U.S. Application Data

(60) Provisional application No. 62/546,785, filed on Aug. 17, 2017.

(51) Int. Cl.

| | |
|---|---|
| ***C10M 169/04*** | (2006.01) |
| ***C10M 149/04*** | (2006.01) |
| ***C10M 149/10*** | (2006.01) |
| *C10N 20/00* | (2006.01) |
| *C10N 40/04* | (2006.01) |
| *C10N 60/00* | (2006.01) |
| *C10N 30/00* | (2006.01) |
| *C10N 20/02* | (2006.01) |
| *C10N 20/04* | (2006.01) |
| *C10N 30/02* | (2006.01) |
| *C10N 30/04* | (2006.01) |
| *C10N 30/06* | (2006.01) |

(52) U.S. Cl.
CPC ..... *C10M 169/044* (2013.01); *C10M 149/04* (2013.01); *C10M 149/10* (2013.01); *C10M 2205/022* (2013.01); *C10M 2205/024* (2013.01); *C10M 2209/06* (2013.01); *C10M 2215/04* (2013.01); *C10M 2215/06* (2013.01); *C10M 2215/226* (2013.01); *C10M 2223/00* (2013.01); *C10N 2020/02* (2013.01); *C10N 2020/04* (2013.01); *C10N 2020/071* (2020.05); *C10N 2030/02* (2013.01); *C10N 2030/04* (2013.01); *C10N 2030/06* (2013.01); *C10N 2030/43* (2020.05); *C10N 2030/45* (2020.05); *C10N 2040/042* (2020.05); *C10N 2040/044* (2020.05); *C10N 2060/09* (2020.05)

(58) Field of Classification Search
CPC ..... C10N 2040/04; C10N 2040/042; C10N 2040/044; C10N 2040/045; C10N 2040/046; C10N 2020/071; C10N 2060/09; C10N 2030/43; C10N 2030/45; C10N 2020/02; C10N 2020/04; C10M 169/044; C10M 149/04; C10M 149/10; C10M 2205/022; C10M 2205/024; C10M 2223/00
See application file for complete search history.

(56) References Cited

U.S. PATENT DOCUMENTS

| | | | | |
|---|---|---|---|---|
| 2006/0025316 | A1* | 2/2006 | Covitch | C10M 133/56 508/459 |
| 2009/0221461 | A1* | 9/2009 | Visger | C10M 145/14 508/471 |
| 2009/0305922 | A1* | 12/2009 | Cha | C10M 169/04 508/186 |
| 2011/0287992 | A1* | 11/2011 | Goldblatt | C08F 255/04 508/545 |
| 2011/0297122 | A1* | 12/2011 | Bardasz | C10M 133/56 123/299 |
| 2013/0053288 | A1* | 2/2013 | Macpherson | C10M 159/12 508/459 |
| 2013/0172220 | A1* | 7/2013 | Ruhe, Jr. | C10M 133/56 508/238 |
| 2013/0252864 | A1* | 9/2013 | Knapton | C07F 9/09 508/425 |
| 2014/0274834 | A1* | 9/2014 | Sauer | C10M 149/14 508/233 |
| 2017/0275556 | A1* | 9/2017 | Preston | C10M 157/10 |
| 2018/0371357 | A1* | 12/2018 | Knapton | C10M 149/18 |

FOREIGN PATENT DOCUMENTS

| | | | |
|---|---|---|---|
| EP | 0225048 | A2 | 6/1987 |
| EP | 0674671 | A1 | 10/1995 |
| WO | 2017/105747 | A1 | 6/2017 |

* cited by examiner

*Primary Examiner* — Ellen M McAvoy
(74) *Attorney, Agent, or Firm* — Christopher P. Demas; Teresan W. Gilbert

(57) ABSTRACT

A lubricant composition of an oil of lubricating viscosity, a grafted copolymer viscosity modifier that is an ashless condensation reaction product of an olefin polymer, having a number average molecular weight of about 1000 to about 10,000, comprising carboxylic acid or equivalent functionality grafted onto the polymer backbone, with a monoamine or a polyamine often having a single primary amino group, which exhibits good dispersancy and viscometric performance in a driveline device.

17 Claims, No Drawings

NITROGEN-FUNCTIONALIZED OLEFIN POLYMERS FOR DRIVELINE LUBRICANTS

BACKGROUND

A lubricant composition of an oil of lubricating viscosity, a grafted copolymer viscosity modifier that is an ashless condensation reaction product of an olefin polymer, having a number average molecular weight of about 1000 to about 10,000, comprising carboxylic acid or equivalent functionality grafted onto the polymer backbone, and reacted with a monoamine or a polyamine often having a single primary amino group, which exhibits good dispersancy and viscometric performance in a driveline device, such as a transmission or axle.

U.S. Pat. No. 7,790,661, Covitch et al., Sep. 7, 2010, discloses dispersant viscosity modifiers containing aromatic amines. There is disclosed the reaction product of a polymer comprising carboxylic acid functionality or a reactive equivalent thereof, said polymer having a number average molecular weight of greater than 5,000, and an amine component comprising 3-nitroaniline. The aromatic amine can also be an N,N-dial-kylphenylenediamine such as N,N-dimethyl-1,4,-phenylenediamine. Suitable backbone polymers include ethylene propylene copolymers. An ethylenically unsaturated carboxylic acid material is typically grafted onto the polymer backbone. Maleic anhydride or a derivative thereof is suitable. Conventional lubricant additives may also be present, including additional dispersants, detergents, and other materials. The derivatized graft copolymer can be employed in crankcase lubricating oils for spark-ignited and compression-ignited internal combustion engines.

U.S. Publication 2010/0162981, Adams et al., Jul. 1, 2010, discloses a multi-grade lubricating oil composition with enhanced antiwear properties for use in an internal combustion engine, preferably a diesel engine. The lubricant comprises a base oil, one or more dispersant viscosity modifiers in a total amount of 0.15 to 0.8% by weight, one or more dispersants in a total amount of active dispersants of 1.5 to 3% by weight, one or more detergents, and one or more metal dihydrocarbyl dithiophosphates. An example of a suitable dispersant viscosity modifier is a co-polymer of ethylene-propylene grafted with an active monomer, for example maleic anhydride and then derivatized with an alcohol or amine.

U.S. Pat. No. 5,264,140, Mishra et al., discloses a lubricating oil composition comprising a major amount of a base oil and a minor amount of, as an antioxidant/ dispersant VI improver additive, a lubricant additive. Disclosed is a polymer prepared from ethylene and propylene; an ethylenically unsaturated carboxylic acid material is grafted onto the polymer backbone. Maleic anhydride grafted polyisobutylene may also be used. The intermediate is reacted with an amino aromatic compound.

U.S. Publication 2009/0176672, Goldblatt, Jul. 9, 2009, discloses functional monomers for grafting to low molecular weight polyalkenes and their use in preparation of dispersants and lubricating oil compositions. The polyalkene may have a number average molecular weight range of about 300 to about 10,000.

U.S. Publication 2011/0245119, Sauer, Oct. 6, 2011, discloses multiple function graft polymers useful as dispersants, suitable for controlling sludge, varnish, soot, friction, and wear. The polymer may have a weight average molecular weight of from about 10,000 to about 500,000. A graftable coupling group may undergo condensation reaction with an amine. The products are said to be useful for internal combustion engines. The lubricants optionally may contain about 0.1 to about 10% of one or more detergents, preferably 0.5 to 4%.

PCT publication WO2017/105747, Jun. 22, 2017, discloses nitrogen-functionalized olefin polymers for use in internal combustion engines. The nitrogen-functionalized olefin polymer is grafted with a carboxylic functionality with an aromatic amine.

SUMMARY

The disclosed technology provides a lubricant composition for a driveline system. The lubricant composition includes (a) an oil of lubricating viscosity having a kinematic viscosity at 100° C. of about 2 to about 10 cSt; and (b) at least one viscosity modifier comprising a grafted copolymer; and (c) at least one oil soluble phosphorus containing antiwear agent.

The grafted copolymer includes an oil soluble ashless condensation reaction product of an olefin polymer, having a number average molecular weight ("Mn") as measured by Gel Permeation Chromatography ("GPC") with a polystyrene standard of about 1000 to about 10,000. The olefin copolymer includes carboxylic acid functionality or a reactive equivalent thereof grafted onto the polymer backbone, and the carboxylic functionality is further substituted with an amine. In an embodiment, the amine component is substantially free, or free of aromatic amine.

The backbone polymer of the grafted polymer can be, for example, an ethylene/propylene copolymer backbone, and the carboxylic functionality can be, for example succinic anhydride functionality.

The lubricant can be employed in a method of lubricating a driveline system by supplying the lubricant to the driveline system and operating the system.

The driveline system can be, for example, an automotive gear system, such as, for example, an axle, a drive shaft, a gearbox, a manual or automated manual transmission or a differential.

DETAILED DESCRIPTION

Various preferred features and embodiments will be described below by way of non-limiting illustration.

Oil of Lubricating Viscosity

One component of the disclosed technology is an oil of lubricating viscosity. Such oils include natural and synthetic oils, oil derived from hydrocracking, hydrogenation, and hydrofinishing, unrefined, refined and rc-rcfincd oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene-isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines (2011). The five base oil groups are as follows: Group I (sulfur content >0.03 wt %, and/or <90 wt % saturates, viscosity index 80 to less than 120); Group II (sulfur content ≤0.03 wt %, and ≥90 wt % saturates, viscosity index 80 to less than 120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be a Group II+base oil, which is an unofficial API category that refers to a Group II base oil having a viscosity index greater than or equal to 110 and less than 120, as described in SAE publication "Design Practice: Passenger Car Automatic Transmissions," fourth Edition, AE-29, 2012, page 12-9, as well as in U.S. Pat. No. 8,216,448, column 1 line 57. The oil of lubricating viscosity may also be a Group III+base oil, which, again, is an unofficial API category that refers to a Group III base oil having a viscosity index of greater than 130, for example 130 to 133 or even greater than 135, such as 135-145. Gas to liquid ("GTL") oils are sometimes considered Group III+base oils.

The oil of lubricating viscosity may be an API Group IV oil, or mixtures thereof, i.e., a polyalphaolefin. The polyalphaolefin may be prepared by metallocene catalyzed processes or from a non-metallocene process. The oil of lubricating viscosity may also comprise an API Group I, Group II, Group III, Group IV, Group V oil or mixtures thereof. Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

The oil of lubricating viscosity, or base oil, will overall have a kinematic viscosity at 100° C. of 2 to 10 cSt or, in some embodiments 2.25 to 9 or 2.5 to 6 or 7 or 8 cSt, as measured by ASTM D445. Kinematic viscosities for the base oil at 100° C. or from about 3.5 to 6 or from 6 to 8 cSt are also suitable.

The amount of the oil of lubricating viscosity present is typically the balance remaining after subtracting from 100 wt % the sum of the amount of the performance additives in the composition. Illustrative amounts may include 50 to 99 percent by weight, or 60 to 98, or 70 to 95, or 80 to 94, or 85 to 93 percent.

The lubricating composition may be in the form of a concentrate and/or a fully formulated lubricant. If the lubricating composition of the invention is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Viscosity Modifier

Another component is a viscosity modifier, sometimes called a dispersant viscosity modifier, that is a grafted copolymer that is an ashless condensation reaction product of an olefin polymer with grafted carboxylic acid (or equivalent) functionality, reacted with a monoamine or a polyamine which may have a single primary amino group. If the olefin polymer is an ethylene/propylene copolymer, then said polyamine is not a polyethylene amine). This material may be referred to as a dispersant viscosity modifier, because the olefin polymer may serve to impart viscosity modifier performance and the reacted amine may provide nitrogen or other polar functionality that may impart dispersant performance. Various dispersant viscosity modifiers have been used in the lubrication of driveline devices for controlling oxidation products.

The polymer or copolymer substrate employed in the derivatized graft copolymer will contain grafted carboxylic acid functionality or a reactive equivalent of carboxylic acid functionality (e.g., anhydride or ester). The reactive carboxylic acid functionality will typically be present as a pendant group attached by, for instance, a grafting process. The olefin polymer may be derived from isobutylene or isoprene. In certain embodiments, the polymer may be prepared from ethylene and propylene or it may be prepared from ethylene and a higher olefin within the range of ($C_3$-$C_{10}$) alpha-monoolefins, in either case grafted with a suitable carboxylic acid-containing species.

More complex polymer substrates, often designated as interpolymers, may be prepared using a third component. The third component generally used to prepare an interpolymer substrate may be a polyene monomer selected from conjugated or non-conjugated dienes and trienes. The non-conjugated diene component may be one having from about 5 to about 14 carbon atoms. The diene monomer may be characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer.

The triene component may also be present, which will have at least two non-conjugated double bonds and up to about 30 carbon atoms. Typical trienes include 1-iso-propylidene-3a,4,7,7a-tetrahydroindene, 1-isopropylidenedicyclopentadiene, and 2-(2-methylene-4-methyl-3-pentenyl)-[2.2.1] bicyclo-5-heptene.

Suitable backbone polymers of the olefin polymer variety include ethylene propylene copolymers, ethylene-propylene-alpha olefin terpolymers, ethylene-alpha olefin copolymers, ethylene propylene copolymers further containing a non-conjugated diene, and isobutylene/conjugated diene copolymers, each of which can be subsequently supplied with grafted carboxylic functionality.

Ethylene-propylene or higher alpha monoolefin copolymers may consist of 15 to 80 mole % ethylene and 20 to 85 mole % propylene or higher monoolefin, in some embodiments, the mole ratios being 30 to 80 mole % ethylene and 20 to 70 mole % of at least one $C_3$ to $C_{10}$ alpha monoolefin, for example, 40 to 80 mole % ethylene and 20 to 60 mole % propylene. In another embodiment, the ethylene-propylene or higher alpha monoolefin copolymers may consist of 15 to 80 mole % propylene and 20 to 85 mole % ethylene or higher monoolefin, in some embodiments, the mole ratios being 30 to 80 mole % propylene and 20 to 70 mole % of at least one $C_3$ to $C_{10}$ alpha monoolefin, for example, 45 to 75 mole % propylene and 25 to 55 mole % ethylene. Terpolymer variations of the foregoing polymers may contain up to 15 mole % of a non-conjugated diene or triene.

In these embodiments, the polymer substrate, such as the ethylene copolymer or terpolymer, can be substantially linear and oil-soluble, and is, in an embodiment, a liquid. Also, in certain embodiments the polymer can be in forms other than substantially linear, that is, it can be a branched polymer or a star polymer. The polymer can also be a random copolymer or a block copolymer, including diblocks and higher blocks, including tapered blocks and a variety of other structures. These types of polymer structures are known in the art and their preparation is within the abilities of the person skilled in the art.

The terms polymer and copolymer are used generically to encompass ethylene and/or higher alpha monoolefin polymers, copolymers, terpolymers or interpolymers. These materials may contain minor amounts of other olefinic monomers so long as their basic characteristics are not materially changed.

The polymer of the disclosed technology may have a number average molecular weight (by gel permeation chromatography, polystyrene standard), which can typically be about 1000 to about 10,000, or about 1250 to about 9500, or about 1500 to about 9000, or about 1750 to about 8500, or about 2000 to about 8000, or about 2500 to about 7000 or 7500, or even about 3000 to about 6500, or about 4000 to about 6000. In some cases the number average molecular weight can be from about 1000 to 5000, or from about 1500 or 2000 to about 4000.

An ethylenically unsaturated carboxylic acid material is typically grafted onto the polymer backbone. These materials which are attached to the polymer typically contain at least one ethylenic bond (prior to reaction) and at least one, such as two, carboxylic acid (or its anhydride) groups or a polar group which is convertible into said carboxyl groups by oxidation or hydrolysis. Maleic anhydride or a derivative thereof is suitable. It grafts onto the olefin polymer, (e.g., ethylene copolymer or terpolymer) to give two carboxylic acid functionalities. Examples of additional unsaturated carboxylic materials include maleic anhydride, itaconic anhydride, or the corresponding dicarboxylic acids, such as maleic acid, fumaric acid and their esters, as well as cinnamic acid and esters thereof.

The ethylenically unsaturated carboxylic acid material may be grafted onto the polymer (such as the ethylene/propylene copolymer) in a number of ways. It may be grafted onto the polymer in solution or in molten form with or without using a radical initiator. The free-radical induced grafting of ethylenically unsaturated carboxylic acid materials may also be conducted in solvents, such as hexane or mineral oil. It may be carried out at an elevated temperature in the range of 100° C. to 250° C., e.g., 120° C. to 190° C., or 150° C. to 180° C., e.g., above 160° C.

The free-radical initiators which may be used include peroxides, hydroperoxides, and azo compounds, typically those which have a boiling point greater than about 100° C. and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator may be used in an amount of 0.005% to 1% by weight based on the weight of the reaction mixture solution. The grafting may be carried out in an inert atmosphere, such as under nitrogen blanketing. The resulting polymer intermediate is characterized by having carboxylic acid acylating functions within its structure.

In an alternative embodiment, the unsaturated carboxylic acid material, such as maleic anhydride, can be first condensed with a monoamine or polyamine, typically having a single primary amino group (described below) and the condensation product itself then grafted onto the polymer backbone in analogous fashion to that described above.

The carboxylic acid functionality can also be provided by a graft process with glyoxylic acid or its homologues or a reactive equivalent thereof of the general formula $R^3C(O)(R^4)_nC(O)OR^5$. In this formula $R^3$ and $R^5$ are hydrogen or hydrocarbyl groups and $R^4$ is a divalent hydrocarbylene group. n is 0 or 1. Also included are the corresponding acetals, hemiacetals, ketals, and hemiketals. Preparation of grafts of such glyoxylic materials onto hydrocarbon-based polymers is described in detail in U.S. Pat. No. 6,117,941.

The amount of the reactive carboxylic acid on the polymer chain, and in particular the amount of grafted carboxylic acid on the chain is typically 0.5 to 8 weight percent, or 1 to 7 weight percent, or 1.5 to 6 weight percent, based on the weight of the polymer backbone, or in some embodiments 2 to 5 weight percent. In some embodiments the amount of the reactive carboxylic acid on the polymer chain, and in particular the amount of grafted carboxylic acid on the chain can be from about 1 to about 2, or in other embodiments from about 2 to 3, or from about 3 to 4 weight percent or 4 to 5 weight percent. These numbers represent the amount of carboxylic-containing species with particular reference to maleic anhydride as the graft material. The amounts may be adjusted to account for carboxylic-containing species having higher or lower molecular weights or greater or lesser amounts of acid functionality per molecule, as will be apparent to the person skilled in the art. The grafting may be of an extent to provide an acid functionalized polymer having a total acid number (TAN per ASTM D664) of 5 to 100, 10 to 80, or 15 to 75, or 20 to 70, or about 25 to about 60 or 65 mgKOH/g.

The acid-containing polymer is reacted with a monoamine or a polyamine typically having a single primary amino group. If the olefin polymer is an ethylene/propylene copolymer, then said polyamine is not a poly(ethyleneamine). The reaction may consist of condensation to form an imide, amide, or half-amide or amide-ester (assuming a portion of alcohol is also reacted) or an amine salt. A primary amino group will typically condense to form an amide or, in the case of maleic anhydride, an imide. It is noted that in certain embodiments the amine will have a single primary amino group, that is, it will not have two or more primary amino groups (except perhaps a very small an inconsequential amount of additional primary amino groups within the entire amine component, e.g., less than 5% or 2% or 1% or 0.5%, or 0.01 to 0.1%, especially 1% or less, such as 0.01 to 1%, of amine groups being primary). This feature will minimize the amount of crosslinking that might otherwise occur. Poly(ethyleneamine)s may generally, and in an oversimplified manner, be depicted as $H_2N—(C_2H_4—NH—)_n—C_2H_4—NH_2$, where n may be, for instance, 2 through 6. These typically have on average about 2 primary amino groups, so their use is typically undesirable for functionalization of ethylene/propylene copolymers, so that any undesirable crosslinking may be minimized or avoided. In those embodiments in which the polyamine is not a poly(ethyleneamine), the amine component employed to make the condensation product will be free of or substantially free of poly(ethyleneamine), such as less than 5 percent by weight of the amine component is poly(ethyleneamine), or less than 1 percent, or 0.01 to 0.1 percent by weight.

Suitable primary amines may include aromatic amines, such as amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, such as those derived from naphthalene. Examples of aromatic amines include aniline, N-alkylanilines such as N-methyl aniline, and N-butylaniline, di-(para-methylphenyl)amine, naphthylamine, 4-aminodiphenylamine, N,N-dimethylphenylenediamine, 4-(4-nitro-phenylazo) aniline (disperse orange 3), sulfamethazine, 4-phenoxyaniline, 3-nitroaniline, 4-aminoacetanilide, 4-amino-2-hydroxy-benzoic acid phenyl ester (phenyl amino salicylate), N-(4-amino-5-methoxy-2-methyl-phenyl)-benzamide (fast violet B), N-(4-amino-2,5-dimethoxy-phenyl)-benzamide (fast blue RR), N-(4-amino-2,5-diethoxy-phenyl)-benzamide (fast blue BB), N-(4-amino-phenyl)-benzamide and 4-phenylazoaniline. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which an amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide (i.e., $\phi$-NH-$\phi$-NH—$COCH_2CH(CH_3)NH_2$). Additional aromatic amines include am inocarbazoles, aminoindoles, aminopyrroles, amino-indazolinones, aminoperimidines, mercaptotriazoles, aminophenothiazines, aminopyridiens, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-iso-propyl butanamide, and N-(4-anilinophenyl)-3-{(3-aminopropyl)-(cocoalkyl) amino} butanamide. Other aromatic amines which can be used include various aromatic amine dye intermediates containing multiple aromatic rings linked by, for example, amide structures. Examples include materials of the general structure $\phi$-CONH-$\phi$-$NH_2$ where the phenyl groups may be substituted. Suitable aromatic amines include those in which the amine nitrogen is a substituent on an aromatic carboxylic compound, that is, the nitrogen is not $sp^2$ hybridized within an aromatic ring.

The amine may also be non-aromatic, or in other words, an amine in which an amino nitrogen is not attached directly to a carbon atom of an aromatic ring, or in which an amine nitrogen is not a part of an aromatic ring, or in which an amine nitrogen is not a substituent on an aromatic carboxylic compound. In some instances such non-aromatic amines may be considered to be aliphatic, or cycloaliphatic. Such amines may be straight, or branched or functionalized with some functional group. The non-aromatic amines can include monoamines having, e.g., 1 to 8 carbon atoms, such as methylamine, ethylamine, and propylamine, as well as various higher amines. Diamines or polyamines can also be used, and typically will have only a single primary amino group. Examples include dimethylaminopropylamine, diethylaminopropylamine, dibutylaminopropylamine, dimethylaminoethylamine, diethylaminoethylamine, dibutylaminoethylamine, 1-(2-aminoethyl)piperidine, 1-(2-aminoethyl) pyrrolidone, N,N-dimethylethylamine; 3-(dimethylamino)-1-propylamine; O-(2-aminopropyl)-O'-(2-methoxyethyl) polypropylene glycol; N,N-dimethyldipropylenetriamine, aminoethylmorpholine, 3-morpholinopropylamine; aminoethylethyleneurea and aminopropylmorpholine.

In certain embodiments non-aromatic amines can be used alone or in combination with each other or in combination with aromatic amines. The amount of aromatic amine may, in some embodiments, be a minor amount compared with the amount of the non-aromatic amines, or in some instance, the composition may be substantially free or free of aromatic amine.

In certain embodiments the grafted olefin polymer may have a nitrogen content, calculated using ASTM D5291, of 0.05 to 3 percent by weight, or 0.1 to 2.5, or 0.15 to 2, or 0.2 to 1.75, or 0.25 to 1.6 percent by weight. The amount of the condensation reaction product of the olefin polymer may be 0.1 to 10, or 0.2 to 9, or 0.3 to 8, or 0.4 to 7 percent by weight, or 0.5 to 6 percent by weight.

The grafted copolymer in general is formulated into the lubricant composition to obtain a desired SAE J306 viscosity grade, as shown in the table below.

| J306 SAE Viscosity Grade | Maximum Temperature for Viscosity of 150,000 cP (° C.)[1,2] | Kinematic Viscosity at 100° C. (cSt)[3] Minimum[4] | Kinematic Viscosity at 100° C. (cSt)[3] Maximum |
|---|---|---|---|
| 70 W | −55 | 4.1 | — |
| 75 W | −40 | 4.1 | — |
| 80 W | −26 | 7.0 | — |
| 85 W | −12 | 11.0 | — |
| 80 | — | 7.0 | <11.0 |
| 85 | — | 11.0 | <13.5 |
| 90 | — | 13.5 | <18.5 |
| 110 | — | 18.5 | <24.0 |
| 140 | — | 24.0 | <32.5 |
| 190 | — | 32.5 | <41.0 |
| 250 | — | 41.0 | — |

[1]Using ASTM D2983.
[2]Using ASTM D445

The viscosity for driveline systems can reach to SAE140 and sometime higher, but more typically SAE110 is desirable.

For example, the grafted copolymer would be employed by one of ordinary skill in an amount to achieve a kinematic viscosity of the resulting lubricant composition at 100° C. ("KV100") of about 2 to about 30 cSt, or in some embodiments about 3 to about 25 cSt, or about 4 to about 20, or even from about 5 to about 15 cSt. While one of ordinary skill would readily be able to determine the level of grafted copolymer needed to achieve the desired KV100, Table 1 below provides a helpful reference for determining the appropriate concentration of the grafter polymer.

| | | | KV100 of Lubricant Composition (cSt) | | | |
|---|---|---|---|---|---|---|
| | | Base Oil Vis (cSt) | 6 | 8 | 12.5 | 26 |
| | | | wt % of polymer | | | |
| Number average molecular weight (Mn) of polymer | 2500 | 2 | 35 | 44 | 56 | |
| | | 3 | 24 | 35 | 50 | |
| | | 4 | 15.5 | 27 | 44 | |
| | | 6 | 0 | 17.5 | 36.5 | |
| | 5000 | 2 | 15.5 | 19.5 | 25.5 | 35 |
| | | 3 | 9.5 | 13.5 | 20 | 30 |
| | | 4 | 6 | 10 | 17 | 28 |
| | | 6 | 0 | 6 | 12.3 | 25 |
| | 7500 | 2 | 12 | 15 | 19 | 26.5 |
| | | 3 | 7 | 10 | 14.5 | 22.5 |
| | | 4 | 5 | 8 | 13 | 20.5 |
| | | 6 | | 4.5 | 9.5 | 17.5 |

For example, the grafted copolymer may, in one embodiment, be present in the lubricant composition from about 1 to about 60 percent by weight of the composition, or about 2 to about 55, about 3 to about 50, about 4 to about 45, about 5 to about 40, about 5 to about 35, about 10 to about 30 or about 10 to about 20 percent by weight. In another embodiment, the grafted copolymer may be present in the lubricant composition from about 5 to about 60, or about 10 to about 50, or about 15 to about 40 percent by weight.

Other Viscosity Modifiers

The oil of lubricating viscosity will generally be selected so as to provide, among other properties, an appropriate viscosity (both kinematic viscosity and high temperature high shear viscosity) and viscosity index. Most modern driveline lubricants are multigrade lubricants which contain viscosity index improvers to provide suitable viscosity at both low and high temperatures, that is, a viscosity modifier, other than the grafted copolymer described above (containing the nitrogen functionality), that is to say, a supplemental viscosity modifier. While the viscosity modifier is sometimes considered a part of the base oil, it is more properly considered as a separate component, the selection of which is within the abilities of the person skilled in the art.

Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styreneisoprene), styrene-maleic ester copolymers, and similar polymeric substances including homopolymers, copolymers, and graft copolymers, including polymers having linear, branched, or star-like structures. The DVM may comprise a nitrogen-containing methacrylate polymer or nitrogen-containing olefin polymer, for example, a nitrogen-containing methacrylate polymer derived from methyl methacrylate and dimethylaminopropyl amine.

The DVM may alternatively comprise a copolymer with units derived from an α-olefin and units derived from a carboxylic acid or anhydride, such as maleic anhydride, in part esterified with a branched primary alcohol and in part reacted with an amine-containing compound.

Examples of commercially available VMs, DVMs and their chemical types may include the following: polyisobutylenes (such as Indopol™ from BP Amoco or Parapol™ from ExxonMobil); olefin copolymers (such as Lubrizol® 7060, 7065, and 7067, and Lucant® HC-2000, HC-1100, and HC-600 from Lubrizol); hydrogenated styrenediene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 50% or to 20% by weight, depending on the application. Concentrations of 1 to 20%, or 1 to 12%, or 3 to 10%, or alternatively 20 to 40%, or 20 to 30% by weight may be used.

Antiwear Additive

The lubricant composition will also contain an antiwear additive. Antiwear additives can include, for example, thiophosphates, phosphates, thiophosphites, phosphites, pyrophosphates, polyphosphites, or mixtures thereof.

A particular antiwear additive that may be employed in the lubricant composition is one containing a substantially sulfur-free alkyl phosphate amine salt with at least 30 mole percent of the phosphorus atoms are in an alkyl pyrophosphate structure, as opposed to an orthophosphate (or monomeric phosphate) structure. The amine of the amine salt may be represented by $R^2 3N$, where each $R^2$ is independently hydrogen or a hydrocarbyl group or an ester-containing group, or an ether-containing group, provided that at least one $R^2$ group is a hydrocarbyl group or an ester-containing group or an ether-containing group (that is, not $NH_3$). Suitable hydrocarbyl amines include primary, secondary or tertiary amines having 1 to 18 carbon atoms, or 3 to 12, or 4 to 10 carbon atoms, or mixtures thereof. A detailed description of the substantially sulfur-free alkyl phosphate amine salt antiwear agent may be found at paragraphs [0017] to [0040] of WO 2017/079016, published 11 May 2017, hereby incorporated by reference.

The amount of the antiwear additive containing a substantially sulfur-free alkyl phosphate amine salt in the lubricant composition may be, for example, from 0.1 to 5 percent by weight. This amount refers to the total amount of the phosphate amine salt or salts, of whatever structure, both ortho-phosphate and pyrophosphate (with the understanding that at least 30 mole percent of the phosphorus atoms are in an alkyl pyrophosphate salt structure). The amounts of the phosphate amine salts in the pyrophosphate structure may be readily calculated therefrom. Alternative amounts of the alkyl phosphate amine salt may be 0.2 to 3 percent, or 0.2 to 1.2 percent, or 0.5 to 2 percent, or or 0.6 to 1.7 percent, or 0.6 to 1.5 percent, or 0.7 to 1.2 percent by weight. The amount may be suitable to provide phosphorus to the lubricant formulation in an amount of 200 to 3000 parts per million by weight (ppm), or 400 to 2000 ppm, or 600 to 1500 ppm, or 700 to 1100 ppm, or 1100 to 1800 ppm.

Other antiwear additives suitable for the lubricant composition include, for example, titanium compounds, tartrates, tartrimides, oil soluble amine salts of phosphorous compounds, sulfurized olefins, metal dihydrocarbyl-dithiophosphates (such as zinc dialkyldithiphosphates [ZDDP]), phosphites (such as dibutyl phosphite), phosphonates, thiocarbamate-containing compounds, such as thiocarbamate esters, alkylene-coupled thiocarbamates, bis(S-alkyldithiocarbanyl) disulphides, and oil soluble phosphorus amine salts.

The antiwear agent may in one embodiment include a tartrate, or tartrimide as disclosed in International Publication WO 2006/044411 or Canadian Patent CA 1 183 125.

The tartrate or tartrimide may contain alkyl-ester groups, where the sum of carbon atoms on the alkyl groups is at least 8. The antiwear agent may in one embodiment include a citrate as is disclosed in US Patent Application 20050198894.

In one embodiment the oil soluble phosphorus amine salt antiwear agent includes an amine salt of a phosphorus acid ester or mixtures thereof. The amine salt of a phosphorus acid ester includes phosphoric acid esters and amine salts thereof, dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components). The amine salt of the phosphorus compound may be a salt as disclosed in U.S. Pat. No. 3,197,405 (sulphur-containing), or in US Patent Application 2010/0016188 (sulphur-free).

In one embodiment the hydrocarbyl amine salt of an alkylphosphoric acid ester is the reaction product of a C14 to C18 alkyl phosphoric acid with Primene 81R™ (produced and sold by Rohm & Haas, or Dow Chemicals) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81 R™, and mixtures thereof.

Non-phosphorus-containing anti-wear agents include borate esters (including borated epoxides), sodium borates, potassium borates, dithiocarbamate compounds, molybdenum-containing compounds, and sulfurized olefins.

The antiwear agent (other than the compound of the invention) may be present in an amount such that the molar ratio of sulfur-free alkyl phosphate amine salt to additional antiwear agent may be from 1:1 to 1:5, or 1:1 to 5:1, or 1:1 to 1:4, or 1:1 to 4:1, or 1:1 to 1:2, or 1:1 to 2:1.

Other Components

Dispersant

Another material which may optionally be present in the lubricant composition is a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

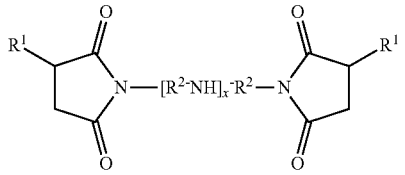

where each R' is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the R' groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials formed by the condensation of a higher molecular weight alkyl substituted phenol, an alkylene polyamine, and an aldehyde such as formaldehyde. They are described in more detail in U.S. Pat. No. 3,634,515.

Other dispersants include polymeric dispersant additives, which may be hydro-carbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant in a fully formulated lubricant of the present technology may be at least 0.1% of the lubricant composition, or at least 0.3% or 0.5% or 1%, and in certain embodiments at most 9% or 8% or 6% or often 4% or 3% or 2% by weight.

The lubricant formulations described herein will further contain extreme pressure agents, include sulfur-containing extreme pressure agents and chlorosulfur-containing EP agents. Examples of such EP agents include organic sulfides and polysulfides such as dibenzyldisulfide, bis-(chlorobenzyl)disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; metal thiocarbamates such as zinc dioctyldithiocarbamate; the zinc salts of a phosphorodithioic acid; amine salts of sulfur-containing alkyl and dialkylphosphoric acids, including, for example, the amine salt of the reaction product of a dialkyldithiophosphoric acid with propylene oxide; dithiocarbamic acid derivatives; and mixtures thereof. The amount of extreme pressure agent, if present, may be 0.05% to 10%, or 0.5% to 10%, or 1% to 7%, or 2% to 6%, or 3% to 5%, or4% to 5% by weight. The EP agent may also be employed at levels of less than 0.5% by weight, such as, for example, from 0.05 to about 0.2% by weight.

Another additive that will be present is a dimercaptothiadiazole (DMTD) derivative, which may be used as a copper corrosion inhibitor. The dimercaptothiadiazole derivatives typically are soluble forms or derivatives of DMTD. Materials which can be starting materials for the preparation of oil-soluble derivatives containing the dimercaptothiadiazole nucleus can include 2,5-dimercapto-[1,3,4]-thiadiazole, 3,5-dimercapto-[1,2,4]-thiadiazole, 3,4-dimercapto[1,2,5]-thiadiazole, and 4,-5-dimercapto-[1,2,3]-thiadiazole. Of these the most readily available is 2,5-dimercapto-[1,3,4]-thiadiazole. Various 2,5-bis-(hydrocarbon dithio)-1,3,4-thiadiazoles and 2-hydrocarbyldithio-5-mercapto-[1,3,4]-thiadiazoles may be used. The hydrocarbon group may be aliphatic or aromatic, including cyclic, alicyclic, aralkyl, aryl and alkaryl. Similarly, carboxylic esters of DMTD are known and may be used, as can condensation products of alpha-halogenated aliphatic monocarboxylic acids with DMTD or products obtained by reacting DMTD with an aldehyde and a diaryl amine in molar proportions of from about 1:1:1 to about 1:4:4. The DMTD materials may also be present as salts such as amine salts. In other embodiments, the DMTD compound may be the reaction product of an alkyl phenol with an aldehyde such as formaldehyde and a dimercaptothiadiazole. Another useful DMTD derivative is obtained by reacting DMTD with an oil-soluble dispersant, such as a succinimide dispersant or a succinic ester dispersant.

The amount of the DMTD compound, if present, may be 0.01 to 5 percent by weight of the composition, depending in part on the identity of the particular compound, e.g., 0.01 to 1 percent, or 0.02 to 0.4 or 0.03 to 0.1 percent by weight. Alternatively, if the DMTD is reacted with a nitrogen-containing dispersant, the total weight of the combined product may be significantly higher in order to impart the same active DMTD chemistry; for instance, 0.1 to 5 percent, or 0.2 to 2 or 0.3 to 1 or 0.4 to 0.6 percent by weight.

Detergent

The lubricant formulations described herein may optionally contain an alkaline earth metal detergent, which may optionally be overbased. Detergents, when they are overbased, may also be referred to as overbased or superbased salts. They are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials may be prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN, ASTM D2896), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis by dividing by the fraction of the detergent (as supplied) that is not oil. Some useful detergents may have a TBN of 100 to 800, or 150 to 750, or, 400 to 700.

While the metal compounds useful in making the basic metal salts are generally any Group 1 or Group 2 metal compounds (CAS version of the Periodic Table of the Elements), the disclosed technology will typically use an alkaline earth such as Mg, Ca, or Ba, typically Mg or Ca, and often calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^2$-T-$(SO_3^-)_a$ or $R^3$—$(SO_3^-)_b$, where a and b are each at least one; T is a cyclic nucleus such as benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. The groups T, $R^2$, and $R^3$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear ehain, and in some instances predominantly in the 2 position.

Another overbased material is an overbased phenate detergent. The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^1$ groups for each phenol compound. In some embodiments, the $R^1$ group can include a polyolefin derived from a oligomers of an olefin, branched or straight, having 3 to 8 carbon atoms, or at least 4 carbon atoms, such as, for example, polybutene or polyisobutylene. Phenate detergents are also sometimes provided as bridged species, such as sulfur or formaldehyde coupled. In some embodiments, the overbased phenate can be a sulfurized calcium alkyl phenate.

In one embodiment, the overbased material may be an overbased saligenin detergent. A general example of such a saligenin derivative can be represented by the formula

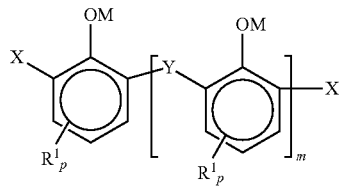

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R_1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit of formula (I) or formula (II) and each end of the compound having a terminal group of formula (III) or (IV):

(I)

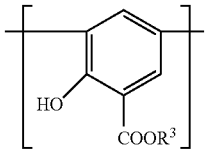

(II)

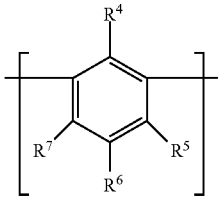

(III)

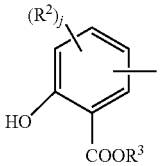

(IV)

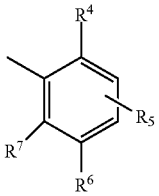

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

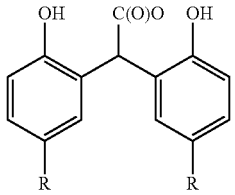

wherein each R is independently an alkyl group containing at least 4 or 8 carbon atoms, provided that the total number of carbon atoms in all such R groups is at least 12 or 16 or 24. Alternatively, each R can be an olefin polymer substituent. Overbased glyoxylic detergents and their methods of preparation are disclosed in greater detail in U.S. Pat. No. 6,310,011 and references cited therein.

The overbased detergent can also be an overbased salicylate, e,g., a calcium salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

The amount of the overbased detergent, if present in the formulations of the present technology, is typically at least 0.1 weight percent on an oil-free basis, such as 0.2 to 3 or 0.25 to 2, or 0.3 to 1.5 weight percent, or alternatively at least 0.6 weight percent, such as 0.7 to 5 weight percent or 1 to 3 weight percent. Alternatively expressed, the detergent may be in an amount sufficient to provide 0 to 500, or 0 to 100, or 1 to 50 parts by million by weight of alkaline earth metal. Either a single detergent or multiple detergents can be present.

Other conventional components may also be included. Examples include friction modifiers, which are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| | |
|---|---|
| fatty phosphites | borated alkoxylated fatty amines |
| fatty acid amides | metal salts of fatty acids |
| fatty epoxides | sulfurized olefins |
| borated fatty epoxides | fatty imidazolines |
| fatty amines | condensation products of carboxylic acids and polyalkylene-polyamines |
| glycerol esters | |
| borated glycerol esters | metal salts of alkyl salicylates |
| alkoxylated fatty amines | amine salts of alkylphosphoric acids |
| oxazolines | ethoxylated alcohols |
| hydroxyalkyl amides | imidazolines |
| dialkyl tartrates | polyhydroxy tertiary amines |
| | fatty phosphonates |
| molybdenum compounds | and mixtures of two or more thereof. |

The amount of friction modifier, if present, may be 0.05 to 5 percent by weight, or 0.1 to 2 percent, or 0.1 to 1.5 percent by weight, or 0.15 to 1 percent, or 0.15 to 0.6 percent, or 0.5 to 2 percent, or 1 to 3 percent.

Another optional component may be an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

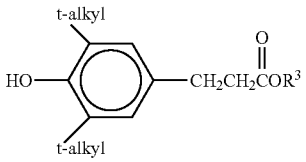

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine. If an aromatic amine is used as a component of the above-described phosphorus compound, it may itself impart some antioxidant activity such that the amount of any further antioxidant may be appropriately reduced or even eliminated.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Typical amounts of antioxidants will, of course, depend on the specific antioxidant and its individual effectiveness, but illustrative total amounts can be 0 to 5 percent by weight, or 0.01 to 5 percent by weight, or 0.15 to 4.5 percent, or 0.2 to 4 percent, or 0.2 to 1 percent or 0.2 to 0.7 percent.

Other materials that may be present include tartrate esters, tartramides, and tartrimides. Examples include oleyl tartrimide (the imide formed from oleylamine and tartaric acid) and oleyl diesters (from, e.g., mixed C12-16 alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.01 to 5 weight %, or 0.05 to 5 or 0.1 weight % to 5 weight %, or 0.1 to 1.0 weight percent, or 0.1 to 0.5 weight percent, or 0.2 to 3 weight %, or greater than 0.2 weight % to 3 weight %.

Other additives that may optionally be used in lubricating oils, in their conventional amounts, include pour point depressing agents, color stabilizers and anti-foam agents.

Typically lubricants for the driveline system encompass automotive gear oils, including, for example, axle oils, gear oils, gearbox oils, drive shaft oils, traction drive transmission fluids, and manual or automated manual transmission fluids or off highway oils (such as a farm tractor oil). Gear oils or axle oils for automobile driveline systems may be used, for example, in planetary hub reduction axles, mechanical steering and transfer gear boxes in utility vehicles, synchromesh gear boxes, power take-off gears, limited slip axles, and planetary hub reduction gear boxes.

In some embodiments, the lubricant may be used in a driveline system to lubricate an axle and an automatic transmission, for example, a continuously variable transmissions (CVT), infinitely variable transmissions (IVT), toroidal trans-missions, continuously slipping torque converter clutches (CSTCC), stepped automatic transmissions or dual clutch transmissions (DCT).

A manual or automated manual transmission lubricant may be used in a manual gearbox which may be unsynchronized, or may contain a synchronizer mechanism. The gearbox may be self-contained, or may additionally contain any of a transfer gearbox, planetary gear system, differential, limited slip differential or torque vectoring device, which may be lubricated by a manual transmission fluid.

The gear oil or axle oil may be used in a planetary hub reduction axle, a mechanical steering and transfer gear box in utility vehicles, a synchromesh gear box, a power take-off gear, a limited slip axle, and a planetary hub reduction gear box.

For automotive gear oils, the lubricant composition would have a sulfur content in the range of about 100 to about 40,000 ppm, or about 200 to about 30,000 ppm, or about 300 to about 25,000 ppm. The lubricant composition would also have a phosphorus content of about 200 ppm to about 3000 ppm, or about 400 ppm to about 2000 ppm, or about 500 ppm to about 1800 ppm of the composition.

In particular, the lubricant composition suitable for use in a manual or automated manual transmission, could have a sulfur content in the range of about 300 to about 5000 ppm, or about 500 to about 4000 ppm, or about 1000 to about 3000 ppm of the composition. The lubricant would also have a phosphorus content of about 400 ppm to about 1500 ppm, or about 450 ppm to about 1250 ppm, or about 500 to about 1000 ppm of the composition.

When employed for an axle, the lubricant composition could have a sulfur content in the range of about 5000 to about 40,000 ppm, or about 10,000 to about 30,000 ppm, or about 12,000 to about 25,000 ppm of the composition. The lubricant would also have a phosphorus content of about 400 ppm to about 3000 ppm, or about 500 ppm to about 2000 ppm, or about 1000 to about 1800 ppm of the composition.

The lubricant may also include an alkaline or alkaline earth metal, such as, for example, Ca, Mg and/or Na at up to about 3500 ppm of the lubricant, or for example about 100 to about 3500 ppm, or about 150 to about 2500 ppm, or even about 200 to about 2000 ppm. In some embodiments the lubricant will be substantially free or even free of alkaline or alkaline earth metal, more particularly, substantially free or free of Ca, Mg and/or Na.

The sulfur, phosphorous and alkaline earth metal concentrations above are provided on a diluent free basis and exclusive of any base oil in the formulation.

In an embodiment, the phosphorous levels provided are exclusive of any limited slip friction modifier that might be included in the formulation.

The lubricant may be employed by supplying the lubricant to a driveline system, such as, for example, a gear, an axle, a drive shaft, a gearbox, a manual or automated manual transmission, an automatic transmission, a differential, and the like, and operating the driveline system.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

As used herein, the term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value.

Additionally, as used herein, the term "substantially" means that a value of a given quantity is within ±10% of the stated value. In other embodiments, the value is within ±5% of the stated value. In other embodiments, the value is within ±2.5% of the stated value. In other embodiments, the value is within ±1% of the stated value.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein is useful for lubricant formulations exhibiting good dispersancy (i.e., good sludge performance) as well as viscometric performance, among other benefits, which may be better understood with reference to the following examples.

EXAMPLES

Polymer 1—an olefin co-polymer of ethylene and propylene (43:57 ratio) with an Mn of 4900.

Polymer 2—7000 g of Polymer 1 and 350 g of maleic anhydride were charged to a glass reaction vessel fitted with an air condenser, subsurface addition tube, nitrogen purge (0.5 SCFH), thermocouple and overhead stirring (250 RPM). The reaction was heated via heating mantle to 160° C. with a nitrogen purge for 12 hours. 70 g di-tert-butyl peroxide was charged over 2 hours via a masterflex pump. The reaction was held at 160° C. for 22 hrs before setting up for vacuum distillation. The reaction was heated to 180° C. and placed under vacuum (100-200 mmHg) for 5 hrs. The reaction was then cooled resulting in an amber viscous liquid.

5000 grams of the resulting amber liquid were combined with 4 cSt polyalphaolefin in a glass reaction vessel fitted with Dean and Stark, water condenser, nitrogen purge (0.5

SCFH), overhead stirring (500 RPM), thermocouple and subsurface addition tube. The reaction was heated via a heating mantle to 110° C. while stirring followed by the addition of 322.7 g 3-morpholinopropylamine dropwise via dropping funnel addition over 40 minutes.

The reaction was heated to 160° C. and held at temperature for 5.5 hrs before cooling to room temperature. The product was filtered through calcined diatomaceous earth and filter cloth to produce an amber viscous fluid. The reaction was deemed complete via IR analysis of product showing complete conversion of the anhydride peak to the imide peak.

Fully formulated gear oils were made containing either Polymer 1 or Polymer 2 according to the recipes in the table below. Example 1 and Baseline 1 were formulated to target a kinematic viscosity at 100° C. of 9 cSt, while Example 2 and Baseline 2 were formulated to target a kinematic viscosity at 100° C. of 12 cSt.

| | Example 1 | Example 2 | Baseline 1 | Baseline 2 |
|---|---|---|---|---|
| 4cSt Synthetic base oil PAO 4 | 75.2 | 69.5 | 78 | 73 |
| Polymer 1 | | | 10 | 15 |
| Polymer 2 | 10.24 | 14.8 | | |
| Gear Oil additive package* | 12 | 12 | 12 | 12 |
| Dil Oil | Balance to 100 | Balance to 100 | — | — |
| ASTM D445, Viscosity at 100° C. (cSt) | 9 | 12.26 | 8.64 | 11.9 |

*conventional additive package containing antiwear agents, extreme pressure agents, dispersant, synthetic base fluid, corrosion inhibitor, anti-foam and diluent oil Each fluid was subjected to an oxidation procedure based on CEC L-48-00, as shown below.

| | Example 1 | Example 2 | Baseline 1 | Baseline 2 |
|---|---|---|---|---|
| Oxidation Testing Results (based on CEC L-48-00) | | | | |
| Spot rating | 79 | 80 | 67 | 41 |
| Tube rating | 2 | 2 | 3 | 3 |

For the oxidation test, a higher spot rating and lower tube rating is considered better.

The 12 cSt fluids were also subjected to the L-60-1 oxidation test and the low temperature Brookfield viscosity test.

| | Example 2 | Baseline 2 |
|---|---|---|
| ASTM D2983, Brookfield viscosity at −40° C. (cP) | 44450 | 56530 |
| L-60 (ASTM D5704) test results | Inventive 2 | Baseline for Inv 2 |
| Viscosity Increase (%) | 25 | 20 |
| Pentane insoluble (wt %) (ie ASTM D5704 12) | 0.1 | 1.2 |
| Toluene insoluble (wt %) (ie ASTM D5704 12) | 0.1 | 1.4 |
| Average Carbon/Varnish (merits) (ie ASTM D5704 11.4) | 10 | 4.7 |
| Average Sludge (merits) (ie ASTM D5704 11.3) | 9.6 | 8.6 |

For the L-60 test, a lower result is better for pentane and toluene insolubility, and a higher result is better for the average carbon/varnish and average sludge results.

Polymer 3 through Polymer 24: 7000 g of Polymer 1 and 350 g of maleic anhydride were charged to a glass reaction vessel fitted with an air condenser, subsurface addition tube, nitrogen purge (0.5 SCFH), thermocouple and overhead stirring (250 RPM). The reaction was heated via heating mantle to 160° C. with a nitrogen purge for 12 hours. 70 g di-tert-butyl peroxide was charged over 2 hours via a masterflex pump. The reaction was held at 160° C. for 22 hrs before setting up for vacuum distillation. The reaction was heated to 180° C. and placed under vacuum (100-200 mmHg) for 5 hrs. The reaction was then cooled resulting in an amber viscous liquid.

800 grams of the resulting amber liquid were combined with 4 cSt polyalphaolefin in a glass reaction vessel fitted with Dean and Stark, water condenser, nitrogen purge (0.5 SCFH), overhead stirring (500 RPM), thermocouple and subsurface addition tube. The reaction was heated via a heating mantle to 110° C. while stirring followed by the addition of commercially available amines in table 1 via dropping funnel addition over 40 minutes.

The reaction was heated to 160° C. and held at temperature for 5.5 hrs before cooling to room temperature. The product was filtered through calcined diatomaceous earth and filter cloth to produce an amber viscous fluid. The reaction was deemed complete via IR analysis of product showing complete conversion of the anhydride peak to the imide peak.

TABLE 1

| Entry | Amine name | Amount (g) |
|---|---|---|
| 3 | JEFFAMINE monoamine (M series) | 114.0 |
| 4 | Diethylaminopropylamine | 24.7 |
| 5 | Dimethyldipropylenetriamine | 30.3 |
| 6 | JEFFAMINE monoamine (M series) | 114.0 |
| 7 | Dimethylaminopropylamine | 19.4 |
| 8 | Dibutylaminopropylamine | 35.4 |
| 9 | Dimethylaminoethylamine | 16.7 |
| 10 | 3-(2-methoxyethoxy)propylamine | 25.3 |
| 11 | 1-(2-Aminoethyl)piperazine | 24.6 |
| 12 | 3-Morpholinopropylamine | 27.4 |
| 13 | Aminoethylethyleneurea (70% in Butanol) | 35.0 |
| 14 | 1-(2-Aminoethyl)piperidine | 24.3 |
| 15 | Benzylamine | 20.4 |
| 16 | N-Phenyl-p-phenylenediamine | 35.0 |
| 17 | XTJ-436 | 190.0 |
| 18 | 1-(3-Aminopropyl)imidazole | 23.8 |
| 19 | Tryptamine | 30.4 |
| 20 | α-Methylbenzylamine | 23.0 |
| 21 | Fast Blue RR | 51.7 |
| 22 | 4-Aminobenzanilide | 40.3 |
| 23 | 4-Aminosalicylic acid | 29.1 |
| 24 | 3-Nitroanaline | 26.2 |

Fully formulated gear oil lubricants were prepared which contained a synthetic base oil, a gear oil additive package and the sample Polymers 3 through 24. The gear oils were blended to the same target kinematic viscosity at 100° C. (12 cSt). The formulations for the lubricants are set forth below with all constituents shown on an oil free weight percent basis. Oxidation results are given for each example per procedure based on CEC L-48-00.

Aliphatic Amines

| Example | 3 | 4 | 5 | 6 | 7 | 8 | 9 | 10 |
|---|---|---|---|---|---|---|---|---|
| Polymer | 3 | 4 | 5 | 6 | 7 | 8 | 9 | 10 |
| 4cSt Synthetic base oil PAO 4 | 68.06 | 69.17 | 71.5 | 68.29 | 69.68 | 68.08 | 71.6 | 69.42 |
| Polymer wt % | 16.0 | 15.1 | 13.2 | 15.8 | 14.7 | 15.9 | 13.1 | 14.9 |
| Gear Oil additive package* | 12 | 12 | 12 | 12 | 12 | 12 | 12 | 12 |
| Oxidation Testing Results (based on CEC L 48-00) | | | | | | | | |
| Spot Rating | 64 | 85 | 83 | 70 | 85 | 100 | 100 | 56 |
| Tube rating | 2 | 2 | 2 | 2 | 2 | 2 | 2 | 2 |
| ASTM D445, Viscosity at 100° C. (cSt) | 12.53 | 12.65 | 12.05 | 12.09 | 12.13 | 12.56 | 11.31 | 11.95 |

*conventional additive package containing antiwear agents, extreme pressure agents, dispersant, synthetic base fluid, corrosion inhibitor, anti-foam and diluent oil Heterocyclic Amines

| Example | 11 | 12 | 13 | 14 |
|---|---|---|---|---|
| Polymer | 11 | 12 | 13 | 14 |
| 4cSt Synthetic base oil PAO 4 | 72.06 | 70.45 | 69.3 | 69.4 |
| Polymer wt % | 12.8 | 14.0 | 15.0 | 14.9 |
| Gear Oil additive package* | 12 | 12 | 12 | 12 |
| Oxidation Testing Results (based on CEC L-48-00) | | | | |
| Spot Rating | 79 | 83 | 83 | 83 |
| Tube rating | 2 | 2 | 2 | 2 |
| ASTM D445, Viscosity at 100° C. (cSt) | 11.87 | 12.1 | 12.13 | 12.04 |

*conventional additive package containing antiwear agents, extreme pressure agents, dispersant, synthetic base fluid, corrosion inhibitor, anti-foam and diluent oil Aromatic Amines

| Example | 15 | 16 | 17 | 18 | 19 |
|---|---|---|---|---|---|
| Polymer | 15 | 16 | 17 | 18 | 19 |
| 4cSt Synthetic base oil PAO 4 | 69.47 | 70.18 | 68.33 | 70.69 | 70.69 |
| Polymer wt % | 14.8 | 14.3 | 15.7 | 13.8 | 13.8 |
| Gear Oil additive package* | 12 | 12 | 12 | 12 | 12 |
| Oxidation Testing Results (based on CEC L-48-00) | | | | | |
| Spot Rating | 1 | 87 | 57 | 82 | 83 |
| Tube rating | 2 | 2 | 2 | 2 | 2 |
| ASTM D445, Viscosity at 100° C. (cSt) | 11.97 | 12.54 | 12.55 | 12.07 | 11.79 |

*conventional additive package containing antiwear agents, extreme pressure agents, dispersant, synthetic base fluid, corrosion inhibitor, anti-foam and diluent oil

| Example | 20 | 21 | 22 | 23 | 24 |
|---|---|---|---|---|---|
| Polymer | 20 | 21 | 22 | 23 | 24 |
| 4cSt Synthetic base oil PAO 4 | 68.94 | 70.5 | 71.5 | 71.4 | 70.15 |
| Polymer wt % | 15.2 | 14.0 | 13.2 | 13.3 | 14.3 |
| Gear Oil additive package* | 12 | 12 | 12 | 12 | 12 |
| Oxidation Testing Results (based on CEC L-48-00) | | | | | |
| Spot Rating | 100 | 83 | 82 | 82 | 85 |
| Tube rating | 2 | 2 | 2 | 2 | 2 |
| ASTM D445, Viscosity at 100° C. (cSt) | 12.04 | 12.11 | 12.17 | 12.17 | 12.04 |

*conventional additive package containing antiwear agents, extreme pressure agents, dispersant, synthetic base fluid, corrosion inhibitor, anti-foam and diluent oil Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of," when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricant composition for a driveline system comprising:

(a) an oil of lubricating viscosity having a kinematic viscosity at 100° C. of about 2 to about 10 cSt;

(b) 3 to 50 wt % of the composition of at least one viscosity modifier comprising a grafted copolymer that is an oil soluble ashless condensation reaction product of an olefin polymer, having a number average molecular weight ("Mn") as measured by Gel Permeation Chromatography ("GPC") with a polystyrene standard of about 1000 to about 10,000, comprising carboxylic acid functionality or a reactive equivalent thereof grafted onto the polymer backbone, with an amine that is substantially free of aromatic amine, provided that if the olefin polymer is an ethylene/propylene copolymer, then said amine is one of an aliphatic amine, or a heterocyclic amine;

(c) at least one oil soluble phosphorus containing antiwear agent wherein the lubricant is for an automotive gear and has a sulfur content of about 100 to about 40,000 ppm and a phosphorus content of about 200 ppm to about 3000 ppm.

2. The lubricant composition of claim 1 wherein the grafted copolymer is present in an amount to provide the lubricating composition a desired kinematic viscosity according to SAE J306 of from 70W to 250.

3. The lubricant composition of claim 1 wherein the grafted copolymer comprises an ethylene/propylene copolymer backbone with grafted succinic anhydride functionality.

4. The lubricant composition of claim 1 wherein the amine component comprises a primary amine.

5. The lubricant composition of claim 1, wherein the amine component is an aliphatic amine, heterocyclic amine or mixtures thereof.

6. The lubricant composition of claim 5, wherein the amine is a non-aromatic amine selected from N,N-Dimethylethylamine; 3-(Dimethylamino)-1-propylamine; 3-(Diethylamino)propylamine; 3-(Dibutylamino)propylamine; O-(2-Aminopropyl)-O'-(2-methoxyethyl)polypropylene glycol; N,N-Dimethyldipropylenetriamine; 3-Morpholinopropylamine; Aminoethylethyleneurea; or mixtures thereof.

7. The lubricant of any of claim 5 wherein the amine component comprises 3-Morpholinopropylamine.

8. The lubricant of claim 1 wherein the grafted olefin polymer of (b) has a nitrogen content of about 0.1 to 10 percent by weight.

9. The lubricant of claim 1 wherein the lubricant is for a manual or automated manual transmission and has a sulfur content of about 300 to about 5000 ppm.

10. The lubricant of claim 1 through wherein the lubricant is for an axle fluid and has a sulfur content of about 5000 to about 40,000 ppm.

11. The lubricant composition of claim 1, where the antiwear agent comprises (thio)phosphates, phosphates, (thio)phosphites, phosphites, pyrophosphates, polyphosphites, or mixtures thereof.

12. The lubricant composition of claim 1, wherein the composition further comprises an extreme pressure agent at about 0.05 to about 10 weight percent of the composition.

13. The lubricant of claim 1 wherein the lubricant is for an automotive gear and has a phosphorus content of about 200 ppm to about 3000 ppm of the composition.

14. The lubricant of claim 13 wherein the lubricant is for a manual or automated manual transmission and has a phosphorus content of about 400 ppm to about 1500 ppm of the composition.

15. The lubricant of claim 14 wherein the lubricant is for an axle fluid and has a phosphorus content of about 400 ppm to about 3000 ppm of the composition.

16. A method for lubricating a driveline system by supplying thereto the lubricant composition of claim 1.

17. The method of claim 16, wherein the driveline system is selected from at least one of a gear, an axle, a drive shaft, gearbox, a manual or automated manual transmission, or a differential.

* * * * *